US008689903B2

(12) United States Patent
Beuershausen et al.

(10) Patent No.: US 8,689,903 B2
(45) Date of Patent: Apr. 8, 2014

(54) CORING APPARATUS AND METHODS

(75) Inventors: Chris C. Beuershausen, Magnolia, TX (US); Juan Miguel Bilen, The Woodlands, TX (US); Larry M. Hall, Kingwood, TX (US); Thomas Uhlenberg, Niedersachsen (DE); Jason R. Habernal, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 410 days.

(21) Appl. No.: 13/083,201

(22) Filed: Apr. 8, 2011

(65) Prior Publication Data

US 2011/0253452 A1 Oct. 20, 2011

Related U.S. Application Data

(60) Provisional application No. 61/324,194, filed on Apr. 14, 2010.

(51) Int. Cl.
*E21B 47/09* (2012.01)

(52) U.S. Cl.
USPC ..... 175/46; 175/58

(58) Field of Classification Search
USPC ..... 175/44, 46, 58, 244
See application file for complete search history.

(56) References Cited

U.S. PATENT DOCUMENTS

| | | | | |
|---|---|---|---|---|
| 4,499,956 | A * | 2/1985 | Campbell et al. | 175/46 |
| 4,601,354 | A * | 7/1986 | Campbell et al. | 175/46 |
| 5,417,295 | A | 5/1995 | Rao et al. | |
| 5,568,838 | A | 10/1996 | Struthers et al. | |
| 6,006,844 | A | 12/1999 | Van Puymbroeck et al. | |
| 6,659,204 | B2 * | 12/2003 | Aumann et al. | 175/244 |
| 6,695,076 | B2 * | 2/2004 | Masui et al. | 175/58 |
| 6,719,070 | B1 | 4/2004 | Van Puymbroeck et al. | |
| 7,004,265 | B2 | 2/2006 | Van Puymbroeck et al. | |
| 7,347,281 | B2 | 3/2008 | Zastresek | |
| 7,878,269 | B2 * | 2/2011 | Cravatte | 175/58 |
| 8,146,684 | B2 * | 4/2012 | Cravatte | 175/58 |
| 8,297,376 | B2 * | 10/2012 | Cravatte | 175/58 |
| 2009/0159335 | A1 | 6/2009 | Cravatte | |

OTHER PUBLICATIONS

F.T. Peixoto Filho et al.; "Brazilian Pre-Salt: The Challenges of Coring at a New Frontier," SPE 139195, SPE Latin American & Caribbean Petroleum Engineering Conference, Lima, Peru, Dec. 1-3, 2010, pp. 1-7.

Al-Sammak et al.; "Coring Unconsolidated Formation—Lower Fars: A Case Study," SPE 119918, 2009 SPE Middle East Oil & Gas Show and Conference, Bahrain International Exhibition Centre, Kingdon of Bahrain, Mar. 15-18, 2009, pp. 1-16.

(Continued)

*Primary Examiner* — William P Neuder
(74) *Attorney, Agent, or Firm* — Mossman, Kumar & Tyler, PC

(57) ABSTRACT

A coring apparatus is provided, which apparatus, in one exemplary embodiment, includes a rotatable member coupled to a drill bit configured to drill a core from a formation, a substantially non-rotatable member in the rotatable member configured to receive the core from the formation, and a sensor configured to provide signals relating to rotation between the rotatable member and the substantially non-rotatable member during drilling of the core from the formation, and a circuit configured to process the signals from the sensor to estimate rotation between the rotatable member and the non-rotatable member.

18 Claims, 4 Drawing Sheets

(56) References Cited

OTHER PUBLICATIONS

Whitebay; "Improved Coring and Core-Handling Procedures for the Unconsolidated Sands of the Green Canyon Area, Gulf of Mexico," SPE 15385, 61st Annual Technical Conference and Exhibition of the Society of Petroleum Engineers, New Orleans, LA, Oct. 5-8, 1986, pp. 1-7.

L.M. Hall et al.; "Coring-While-Drilling With One Bit: New Advances in Wireline-Retrievable Coring," SPE 37371, E&P Exchange, Sep. 1996, p. 832.

Whitebay et al.; "Increasing Core Quality and Coring Performance Through the Use of Gel Coring and Telescoping Inner Barrels," SPE 38687, 1997 SPE Annual Technical Conference and Exhibition, San Antonio, Texas, Oct. 5-8, 1997, pp. 419-434.

Larry M. Hall et al.; "Novel Liner System Improves Coring Performance, Rig Safety, and Wellsite Core Processing," SPE 113294, 2008 Indian Oil and Gas Technical Conference and Exhibition, Mumbai, India, Mar. 4-6, 2008, pp. 1-5.

* cited by examiner

CORING APPARATUS AND METHODS

CROSS REFERENCES TO RELATED APPLICATIONS

This application claims priority from the U.S. Provisional Patent Application having the Ser. No. 61/324,194 filed Apr. 14, 2010.

BACKGROUND OF THE DISCLOSURE

1. Field of the Disclosure

The disclosure relates generally to obtaining core samples from a formation and drilling wellbores in the formation.

2. Description of the Related Art

Oil wells (also referred to as "wellbores" or "boreholes") are drilled with a drill string that includes a tubular member having a drilling assembly (also referred to as the "bottom-hole assembly" or "BHA") at an end of the tubular member. To obtain hydrocarbons such as oil and gas, wellbores are drilled by rotating a drill bit attached at a bottom end of the drill string. The drill string may include a coring tool with a coring drill bit (or "coring bit") at the bottom end of a drilling assembly. The coring bit has a through-hole or mouth of a selected diameter sufficient to enable the core sample to enter into a cylindrical coring barrel inside the drilling assembly (coring inner barrel). One or more sensors may be placed around the core barrel to make certain measurements of the core and of the formation surrounding the wellbore drilled to obtain the core. The length of the core sample that may be obtained is limited to the length of the core barrel, which, in an embodiment, may be 600-feet long or longer. Rotation of the coring inner barrel may cause fracturing of the core sample during drilling, thereby reducing or destroying the core's integrity for measurement. Therefore, it is desirable to detect rotation of and maintain a stationary (or non-rotating) state for the coring inner barrel as it receives the core in order to extract a continuous solid and unbroken core sample.

SUMMARY

In one aspect, a coring apparatus is provided, which apparatus in one exemplary embodiment includes a rotatable member coupled to a drill bit configured to drill a core from a formation, a substantially non-rotatable member in the rotatable member configured to receive the core from the formation, and a sensor configured to provide signals relating to rotation between the rotatable member and the non-rotatable member during drilling of the core from the formation, and a circuit configured to process the signals from the sensor for estimating rotation between the rotatable member and the non-rotatable member.

In another aspect, a method of obtaining a core from a formation is provided, which method in one embodiment may include: rotating a drill bit attached to an outer member to obtain the core from a formation; receiving the core in a substantially non-rotating member disposed in the rotating member; obtaining measurements relating to the rotation of the rotating member relative to the substantially non-rotating member using a sensor; determining relative rotation of the rotating member and the substantially non-rotating member using the sensor measurements; and storing information relating to the relative rotation in a suitable storage medium.

Examples of certain features of the apparatus and method disclosed herein are summarized rather broadly in order that the detailed description thereof that follows may be better understood. There are, of course, additional features of the apparatus and methods disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings, in which like elements have been given like numerals and wherein.

DESCRIPTION OF THE DISCLOSURE

The present disclosure relates to devices and methods for obtaining core samples from earth formations and is described in reference to certain specific embodiments. The concepts and embodiments described herein are susceptible to embodiments of different forms. The drawings show and the written specification describes specific embodiments of the present disclosure for explanation only with the understanding that the present disclosure is to be considered an exemplification of the principles of the disclosure, and is not intended to limit the disclosure to that illustrated and described herein.

Figure 1:
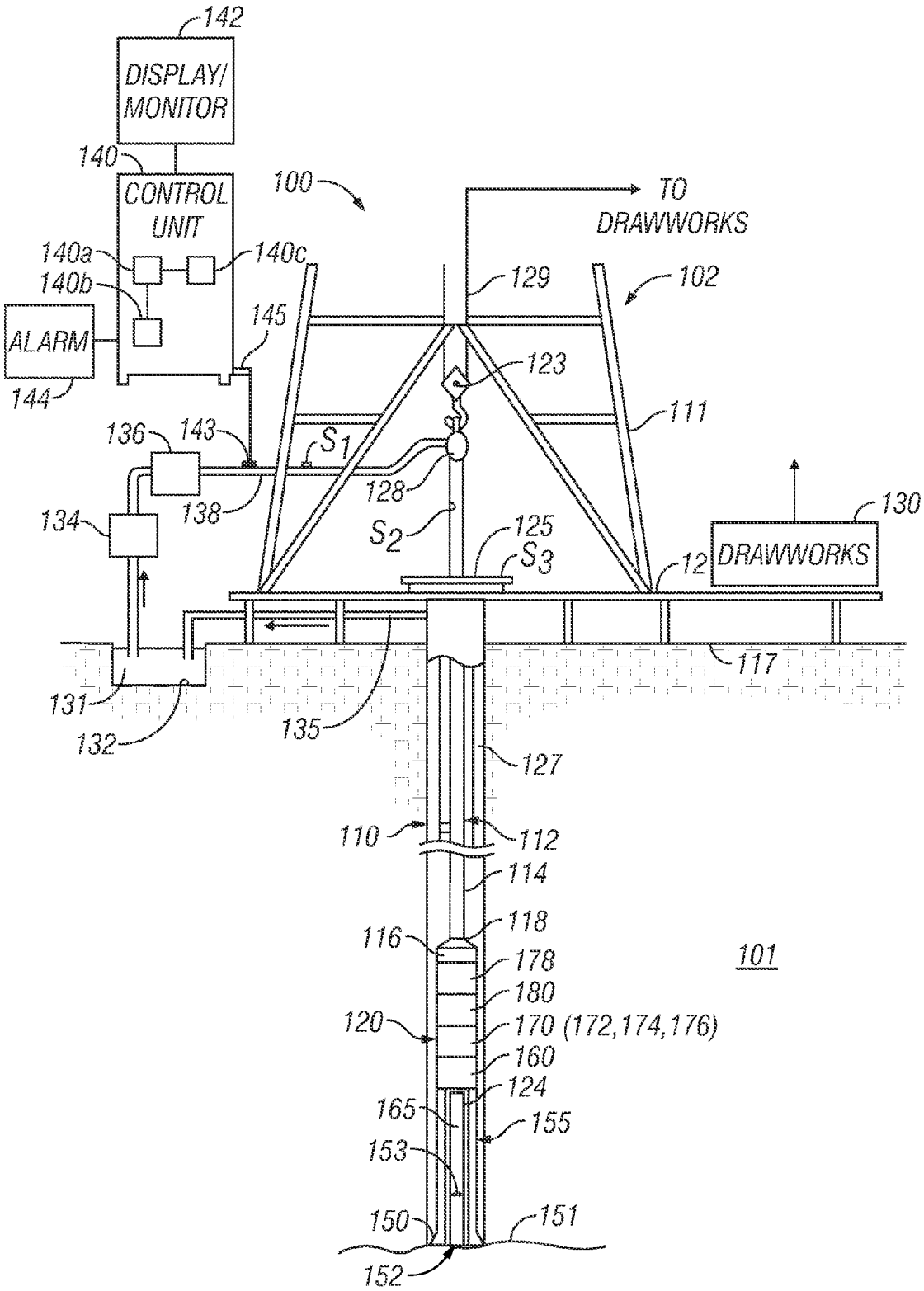
FIG. 1 is an elevation view of a drilling system including a downhole coring tool, according to an embodiment of the present disclosure.

FIG. 1 is a schematic diagram showing an exemplary drilling system 100 that may be utilized for obtaining core samples, determining when the core sample may not be stationary or unstable and for taking appropriate corrective actions when the core is not stationary or is unstable. FIG. 1 shows a wellbore 110 being drilled with a drill string 112 in a formation 101. The drill string 112, in one aspect, includes a tubular member 114 and a drilling assembly 120 attached at a bottom end 118 of the tubular 112 with a suitable connection joint 116. The tubular member 114 typically includes serially connected drill pipe sections. The drilling assembly 120 includes a coring tool 155 that has a drill bit 150 (also referred to herein as the "coring bit") at the bottom end of the drilling assembly 120. The drill bit 150 has a through bore or mouth 152 having an inner diameter 153 substantially equal to the outer diameter of the core 165 to be obtained. The drill bit 150 is attached to a drill collar of the drilling assembly 120. The drill collar includes an inner core barrel 124 for receiving the core 165 therein. In an aspect, the barrel 124 remains stationary when the drilling assembly 120 is rotated to rotate the drill bit 150 to obtain the core 165. Suitable centralizers or support members, such as stabilizers, bearings assemblies, etc. (not shown) may be placed at selected locations between the core barrel and an inside wall of the drilling assembly 120 to provide lateral or radial support to the barrel 124. Details of the coring tool 155 are described in more detail in reference to FIGS. 2-4. In general, the coring tool cuts a core, which core is received by the inner barrel (tubular member). Measurements from one or more sensors associated with the coring tool 155 are used to determine relative movement of the core and a rotating member of the coring tool.

The drilling assembly 120 further may include a variety of sensors and devices, generally designated herein by numeral 160, for taking measurements relating to one or more properties or characteristics, including, but not limited to, core properties, drill bit rotational speed, rate of penetration of the drill bit, rock formation, vibration, stick slip, and whirl. A controller 170 in the drilling assembly 120 and/or the controller 140 at the surface may be configured to process data from downhole sensors, including sensors associated with the coring tool 155 for determining the stability and rotation of the core 165. Additionally, the drilling assembly 120 may include sensors for determining the inclination, depth, and azimuth of the drilling assembly 120 during drilling of the wellbore 110. Such sensors may include multi-axis inclinometers, magnetometers and gyroscopic devices. The controllers 170 and/or 140 also may control the operation of the drilling system and the devices 160. A telemetry unit 178 in the drilling assembly 120 provides two-way communication between downhole devices 160 and the surface controller 140. Any suitable telemetry system may be utilized for the purpose of this disclosure, including, but not limited to, a mud-pulse telemetry, electromagnetic telemetry, acoustic telemetry, and wired-pipe telemetry. The wired-pipe telemetry may include jointed drill pipe sections fitted with data communication links, such as electrical conductors or optical fibers. The data may also be wirelessly transmitted using electromagnetic transmitters and receivers or acoustic transmitters and receivers across pipe joints.

Still referring to FIG. 1, the drilling tubular 112 is conveyed into the wellbore 110 from a rig 102 at the surface 117. The rig 102 includes a derrick 111 that supports a rotary table 125 that is rotated by a prime mover, such as an electric motor or a top drive (not shown), at a desired rotational speed to rotate the drill string 112 and thus the drill bit 150. The drill string 112 is coupled to a draw-works 130 via a pulley 123, swivel 128 and line 129. During drilling operations, the draw-works 130 is operated to control the weight-on-bit, which affects the rate of penetration. During drilling operations a suitable drilling fluid 131 (also referred to as the "mud") from a source or mud pit 132 is circulated under pressure through the drill string 112 by a mud pump 134. The drilling fluid 131 passes into the drill string 112 via a desurger 136 and a fluid line 138. The drilling fluid 131 discharges at the borehole bottom 151. The drilling fluid 131 circulates uphole through the annular space 127 between the drill string 112 and the borehole 110 and returns to the mud pit 132 via a return line 135. A sensor S1 in the line 138 provides information about the fluid flow rate. A surface torque sensor S2 and a sensor S3 associated with the drill string 112 respectively provide information about the torque and the rotational speed of the drill string 112 and drill bit 150. Additionally, one or more sensors (not shown) associated with line 129 are used to provide data regarding the hook load of the drill string 112 and about other desired parameters relating to the drilling of the wellbore 110.

The surface control unit 140 may receive signals from the downhole sensors and devices via a sensor 143 placed in the fluid line 138 as well as from sensors S1, S2, S3, hook load sensors and any other sensors used in the system. The control unit 140 processes such signals according to programmed instructions and displays desired drilling parameters and other information on a display/monitor 142 for use by an operator at the rig site to control the drilling operations. The surface control unit 140 may be a computer-based system that may include a processor 140*a*, memory 140*b* for storing data, computer programs, models and algorithms 140*c* accessible to the processor 140*a* in the computer, a recorder, such as tape unit for recording data and other peripherals. The surface control unit 140 also may include simulation models for use by the computer to process data according to programmed instructions. The control unit responds to user commands entered through a suitable device, such as a keyboard. The control unit 140 is adapted to activate alarms 144 when certain unsafe or undesirable operating conditions occur.

Figure 2:
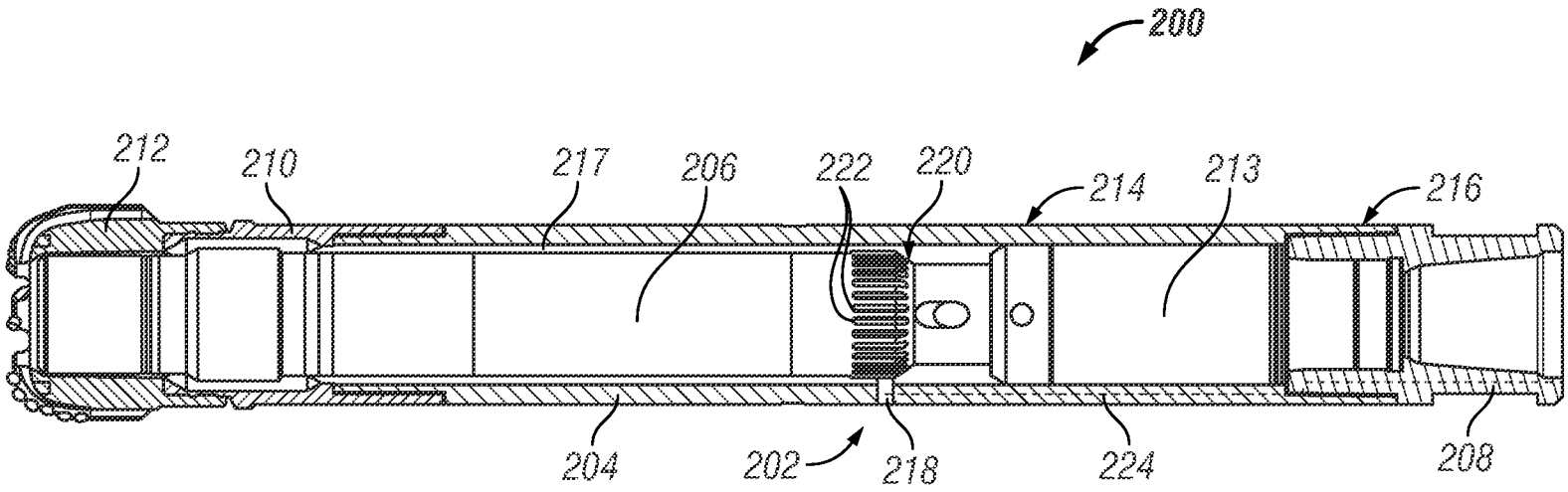
FIG. 2 is a side view of a coring tool with a drill bit, where certain components are removed to show detail, according to an embodiment of the present disclosure.

FIG. 2 is a side view of an embodiment of an exemplary coring tool or apparatus 200, with certain components removed to permit the display of details of elements otherwise obscured, according to one embodiment of the disclosure. The coring tool 200 shown includes an outer member or barrel 204, inner member or barrel 206, a top sub 208, a shank 210, a coring bit (or drill bit) 212 and a rotation measurement apparatus or device 202. Sections of the outer barrel 204, top sub 208, shank 210 and coring bit 212 are shown removed to illustrate certain details of the rotation measurement apparatus 202. In one aspect, the coring bit 212 is a polycrystalline diamond compact (PDC) or natural diamond cutting structure configured to destroy a rock formation as part of the process to form a wellbore, while creating a core formation sample received by the inner barrel 206. The top sub 208 may be coupled to an end of a rotating drill string 112 or BHA 120 (FIG. 1), where the top sub 208, outer barrel 204, shank 210, coring bit 212 and coupling member 213 rotate with the drill string to create the core sample 165 and wellbore 110 (FIG. 1). In an aspect, the coupling member 213 is coupled to the inner barrel 206 by a joint 214 that includes bearings to allow the coupling member 213 to rotate with the outer barrel 204 while the inner barrel 206 remains substantially stationary (non-rotating). In an embodiment, the coupling member 213 is attached to the outer barrel 204 and/or the top sub 208, where each of the components rotate with the drill string 112 (FIG. 1). The outer barrel 204 is coupled to the top sub 208 by any suitable mechanism 216, such as threads, press fit or welding. In one embodiment, drilling fluid may flow from the drill string through the top sub 208 and coupling member 213 through a gap 217 between the outer barrel 204 and inner barrel 206. The fluid flows out the coring bit 212 to carry cuttings in the fluid uphole, along the outside of the outer barrel 204 and drill string.

In an aspect, the rotation measurement apparatus 202 is configured to measure rotation of outer barrel 204 relative to inner barrel 206. In one configuration, the rotation measurement apparatus 202 includes a sensor 218, target 220, target elements 222 and communication link 224. The sensor 218 is configured to sense movement relative to the target 220. In one aspect, the target 220 includes target elements 222, which are used with the sensor 218 to determine rotational motion of the outer barrel 204 relative to the inner barrel 206. In one embodiment, the sensor 218 is embedded in the outer barrel 204 and may be Hall-effect sensor. In one aspect, the target elements 222 may be raised portions or protrusions, such as spaced apart splines on the inner barrel 206. The sensor 218 provides a signal corresponding to each protrusion during rotation of the outer barrel relative to the inner barrel. The signals from the sensor 218 are processed to quantify or determine relative rotation of the outer barrel relative to the inner barrel. The Hall-effect sensor 218 includes a transducer that varies its output voltage in response to changes in magnetic field, where the movement of the sensor 218 relative to the target elements 222 alter the field. Troughs or channels (not shown) may be used instead of protrusions on the inner barrel. Also, any other target shape and size suitable for the Hall-effect sensor 218 may be utilized. In an aspect, the inner barrel 206 and target elements 222 may be made of a conductive material such as steel or an alloy, where the target elements 222 cause a change in the magnetic field to be detected by the Hall-effect sensor 218. In one aspect, the target elements 222 are ridges, splines or raised portions with gaps between the ridges, where the alternating gaps and ridges are detected by the sensor 218. In another embodiment, the target elements 222 and/or the inner barrel 206 may include magnets that affect the magnetic field via rotation, wherein the changes in the field are determined to identify rotation.

In another embodiment, the target elements 222 may be incorporated in a specific pattern and the sensor 218 may be an optical sensor or encoder. The pattern 222 may include alternating stripes of light and dark colors painted on the target 220 or inner barrel 206 that indicate movement of the inner barrel 206 relative to the outer barrel 204. In such an embodiment, the space between the target 220 and sensor 218 is relatively unobstructed to enable the optical sensor 218 to detect movement of the target 220. Therefore, in an embodiment, the drilling fluid is routed around the gap between the sensor 218 and target 220. In another embodiment, the target elements 222 may be radio frequency (RF) tags and the sensor 218 may be an RF tag sensor. In an aspect, the RF tag elements 222 emit signals that indicate the position and/or movement of the inner barrel 206 relative to the sensor 218 and outer barrel 204.

In another embodiment, the target elements 222 may be incorporated in a specific pattern and the sensor 218 may be an optical sensor or encoder. The pattern 222 may be alternating stripes that indicate movement of the inner barrel 206 relative to the outer barrel 204. In another embodiment, the target elements 222 may be splines or ridges and the sensor 218 may be a micro-switch. The micro-switch 218 may be a transducer with a biased roller and/or cam, where the roller maintains contact with the target 220 and emits a signal to indicate when the roller passes over a spline or a ridge. These signals indicate movement of the inner barrel 206 relative to the outer barrel 204. Any other suitable sensor device that provides the relative motion between a rotating member and substantially non-rotating member may be utilized.

As discussed above, the rotation measurement apparatus 202 is configured to measure rotation of the outer barrel 204 relative to inner barrel 206. For example, during a coring operation, the bit 212 and outer barrel 204 rotate at a selected speed, such as 100 RPM to obtain a core from the formation. The inner barrel 206 is configured to remain substantially stationary (non-rotating) to allow the barrel to receive the core and to maintain the core stationary along the radial or lateral direction. By not rotating the inner barrel 206, the core's cylindrical sample from the formation remains attached to the formation, enabling a long (axial length of the cylinder) continuous core sample to be taken. If the inner barrel 206 rotates, the sensor 218 and rotation measurement apparatus 202 will detect a variation from the expected rate of rotation, such as 100 RPM, for example 99 rpm. In the embodiment shown, a control unit 170 or 140 (FIG. 1) may determine that the actual rotation rate of the drill string 112 and outer barrel 204 relative to the inner barrel 206 is different. Comparison (difference) of the rotational rate of the drill bit and the rotational rate measured by the sensor apparatus 202 provides an indication of the inner barrel 206 instability or rotation. For example, if the drill bit is rotating at 100 rpm and the sensor apparatus 218 measurements indicate rotation of 99 rpm, then the inner barrel 206 is rotating at one rpm in the same direction as the outer barrel 204, i.e., 100 rpm-99 rpm, which rotation is sensed or detected (as a difference) to maintain core sample integrity. After inner barrel 206 rotation has been detected by the rotation measurement apparatus 202, the control unit 170 and/or 140 using a processor (172 and/or 140*a*) and program (176 and/or 140*c*), may take one or more corrective actions to avoid damage to the core sample. The system 100 (FIG. 1) may also utilize other parameters to obtain and maintain the integrity of the core sample. For example, the system 100 (FIG. 1) may determine one or more physical drilling and formation parameters and utilizes one or more such parameters to adjust the drilling parameters. Such other physical parameters may include, but are not limited to, vibration, whirl, stick slip, formation type (for example shale, sand, etc.), inclination, rotational speed, and rate of penetration. The drilling parameters altered in response to one or more determined parameters may include altering one or more of: weight-on-bit, drill bit rotational speed, fluid flow rate, rate or penetration, drilling direction, and stopping drilling of the core and retrieving the core to the surface.

Figure 3:
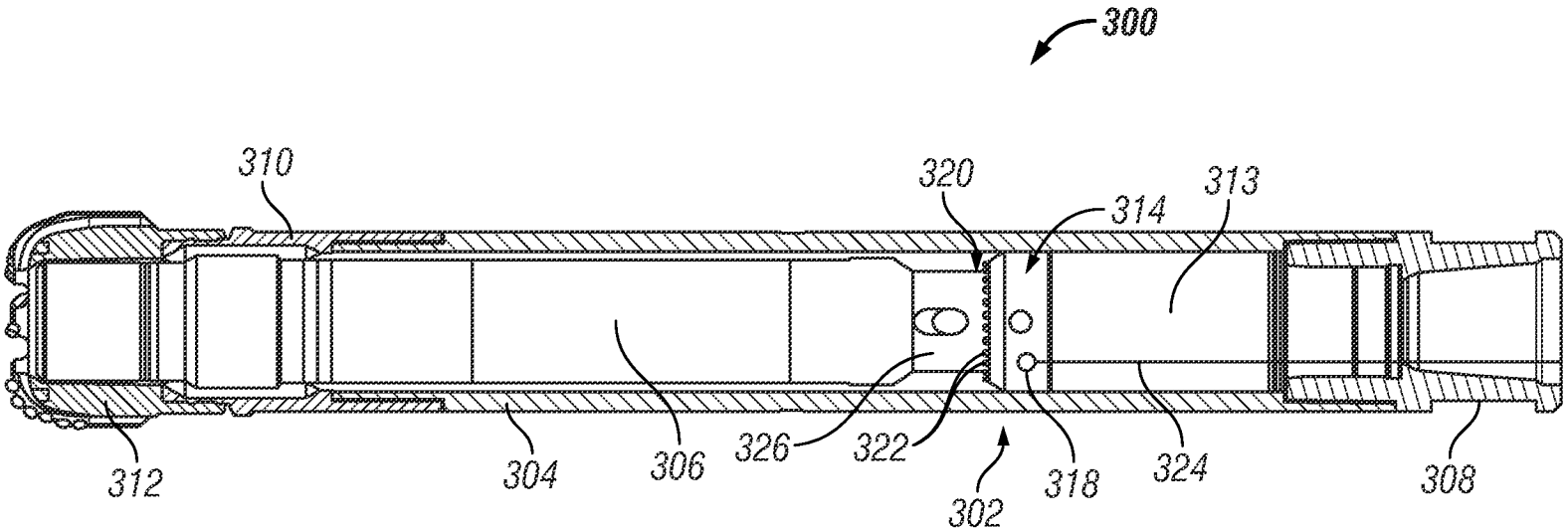
FIG. 3 is a side view of a coring tool with a drill bit, where certain components are removed to show detail, according to an embodiment of the present disclosure.

FIG. 3 is a side view of an embodiment of a coring tool 300 where certain components are removed to permit the display of details of elements otherwise obscured. The coring tool 300 includes a rotation measurement apparatus 302, outer barrel 304, inner barrel 306, top sub 308, shank 310 and coring bit 312. Sections of the outer barrel 304, top sub 308, shank 310 and coring bit 312 have been removed to show certain details of the rotation measurement apparatus 302. The top sub 308 may be coupled to an end of a rotating drill string or BHA, where the top sub 308, outer barrel 304, shank 310, coring bit 312 and coupling member 313 rotate with the drill string to create the core sample. The coupling member 313 is coupled to the inner barrel 306 by a joint 314 that includes bearings to allow the coupling member 313 to rotate with the outer barrel 304 while the inner barrel 306 remains substantially stationary. In an embodiment, the rotation measurement apparatus 302 includes a sensor 318, target 320, target elements 322 and communication link 324. The sensor 318 is configured to sense movement relative to the target 320. The target 320 includes target elements 322, which are used with the sensor 318 to indicate rotational motion of the outer barrel 304 relative to the inner barrel 306. An upper portion 326 of the inner barrel 306 is positioned partially inside of the coupling member 313, where the joint 314 enables the rotation of the coupling member 313 with the outer barrel 304 while the inner barrel 306 remains substantially stationary. As depicted, the rotational measurement apparatus 302 is located proximate to or is a part of the joint 314, where the sensor 318 is embedded in the coupling member 313 and detects movement of the inner barrel 306 by measuring movement of target elements 322. Thus, by sensing movement of inner barrel 306 relative to coupling member 313, the relative movement measurement is the same as an inner barrel 306 and outer barrel 304 movement measurement. As discussed with respect to FIG. 2, the sensor 318 may be one of a Hall-effect sensor, RF sensor, optical encoder/sensor, micro-switch or a combination thereof. Further, the target 320 and elements 322 may be one of splines, RF tags, a stripe pattern, grooves or a combination thereof. In aspects, the system (FIG. 2, 200, FIG. 3, 300) may use short hop telemetry, slip rings, acoustic signals or other suitable techniques to communicate signals between components, such as between rotating and substantially non-rotating members. In the exemplary embodiments shown herein, the target and detector are generally shown proximate to each other. However, any sensor suitable for detecting the relative rotation of the core barrel may be utilized. For instance, a device may be installed external to the target and coupled to the top sub 308, wherein the device includes a sensor detached from such a device. For example, the sensor may be configured to "hang down" into the core barrel, and detect movement of the substantially stationary part relative to the rotating drill string or rotating outer member of the core barrel. In this case, the sensor would not be a part of the coring tool as shown of FIGS. 2 and 3, but external to the coring tool. In another aspect, the sensing element may be a tactile member that comes in contact with the target and generates signals as the tactile member moves over such ridges.

Figure 4:
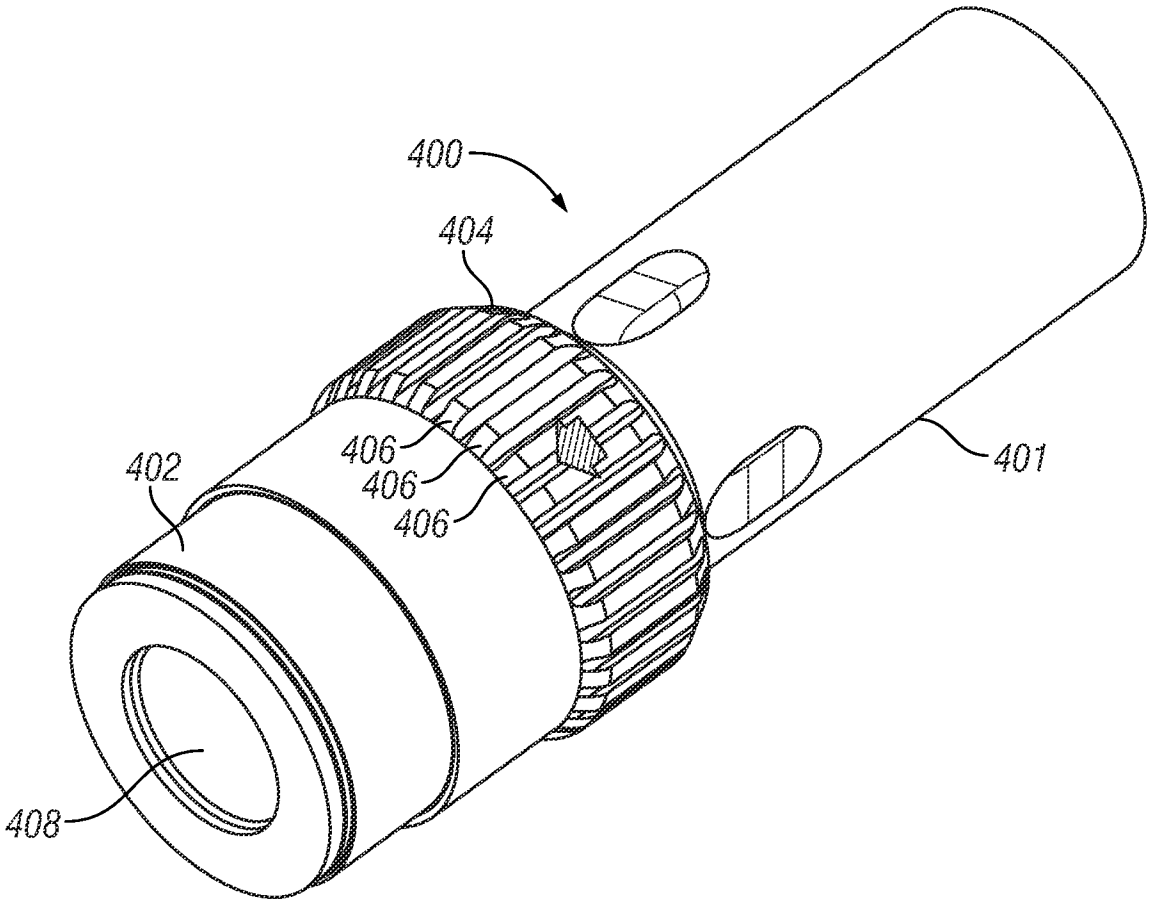
FIG. 4 is a detailed perspective view of a portion of the coring apparatus including components of a rotation measurement apparatus, according to an embodiment of the present disclosure.

FIG. 4 is an embodiment of a detailed perspective view of inner components of a coring tool, including components of or a portion of a rotation measurement apparatus 400. In an embodiment, the rotation measurement apparatus 400 is a portion of, coupled to and/or positioned on an inner barrel with an upper portion 401 and lower portion 402. The rotation measurement apparatus 400 includes a sensor (not shown), target 404 and target elements 406. In aspects, the target 404 and target elements 406 may be machined or formed into the rotation measurement apparatus 400 or may be a separate component coupled to the rotation measurement apparatus 400. For example, the target 404 may be formed from a cast or machined from a conductive metallic or alloy material that may be partially or fully magnetized. The target 404 component may then be coupled to the upper portion 401 or lower portion 402 of the rotation measurement apparatus 400. The lower portion 402 may include threads to couple to adjacent inner barrel parts, such as inner barrel 206 (FIG. 2). As depicted, the lower portion 402 has a cavity 408. In embodiments, the cavity 408 is configured to enable fluid communication of drilling fluid.

In an aspect, the rotation between the inner and outer barrels is detected by a sensor which measures the relative motion between the barrels with or without physical contact between them. In one aspect, the sensing mechanism has a variable gap between the sensor tip (sensing element) and the target to generate the pulse which is amplified and converted into recordable data. The variable gap may be created by slots machined on the inner barrel pieces. The sensing element may be embedded in the outer barrel or placed in a separate sub or device. If relative motion between the barrels varies, the gap between the sensing element and the target varies as a peak or a valley faces the sensing element. The number of slots or splines determines the resolution of the sensor apparatus up to a desired fraction of a rotation or turn. In another aspect, the sensor mechanism may include a tactile sensing element, such as a roller or an arm, wherein the signals are generated as the roller or arm moves over the ridges. The signals from the sensor may be processed by controller 170 and/or 140.

Thus, in one aspect, a coring apparatus is provided, which apparatus in one embodiment includes an outer rotating member coupled to a drill bit for drilling a core, an inner substantially non-rotating member in the outer member and configured to receive a core from a formation, and a sensor apparatus configured to measure rotation of the inner substantially non-rotating member when the rotating member is rotating to drill the core. In one aspect, the sensor apparatus includes a sensor or sensing element and a target. In one aspect, the sensor may be a Hall-effect sensor, a radio frequency sensor, an optical sensor, a micro-switch, or any other suitable sensor. In another aspect, the target may be protrusions, such as splines, channels or recesses, such as grooves, radio frequency tags, stripe patterns, color variations, magnetic markers, or any combination thereof. In one aspect, the target may be located on the substantially non-rotating member and the sensor on the rotating member or vice versa. In another aspect, the coring apparatus further includes a communication link for transmitting signals from the sensor to a controller. The communication link may include one of: a split ring connection associated with the substantially non-rotating member, a short-hop acoustic sensor, a direct connection between the sensor and a controller in a drilling assembly coupled to the coring apparatus.

In another aspect, a method of obtaining a core sample is provided, which method, in one embodiment may include: rotating an outer member with a coring bit to obtain the core from a formation; receiving the core in a substantially non-rotating member disposed in the rotating member; and determining rotation of the substantially non-rotating member using a sensor apparatus during rotation of the rotating member. The method may further include taking a corrective action when the rotation of the substantially non-rotating member is outside a selected limit. In one aspect, the corrective action may include one or more of altering drill bit rotation, altering weight-on-bit, stop receiving the core, retrieving the core; and altering inclination. In aspects, the sensor apparatus may include a sensor and a target. In one aspect, the sensor may be one of a Hall-effect sensor, a radio frequency sensor, an optical sensor, a micro-switch, or any other suitable sensor. In another aspect, the target may be protrusions, such as splines, channels or recesses, such as grooves, radio frequency tags, color variations, and magnetic elements.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure and the following claims.

The invention claimed is:

1. An apparatus for obtaining a core from a formation, comprising:

an outer rotatable member coupled to a drill bit configured to drill the core from the formation;

an inner member in the outer member configured to receive the core therein; and a sensor configured to provide signals for measuring rotation of the inner member when the outer rotating member is rotating to drill the core from the formation, wherein the sensor includes a plurality of targets.

2. The apparatus of claim 1, wherein the inner member is substantially non-rotatable, and further comprising a coupling member coupled to the inner barrel by a joint that includes a bearing, the bearing allowing the coupling member to rotate with the outer barrel while the inner barrel remains substantially stationary.

3. The apparatus of claim 1, wherein the sensor further includes a sensing element.

4. The apparatus of claim 3, wherein the plurality of targets are selected from a group consisting of: (i) protrusions; (ii) splines; (iii) channels; (iv) recesses; (v) radio frequency tags; (vi) a stripe patterns; (vii) color variations; and (viii) magnetic markers.

5. The apparatus of claim 3, wherein the plurality of targets and the sensing element are located as one of: (i) the plurality of targets on the inner member and the sensing element on the outer member; (ii) the plurality of targets on the outer member and the sensing element on the inner member; and (iii) the plurality of targets on the inner member and the sensing element on an external member axially displaced from the plurality of targets.

6. The apparatus of claim 1, wherein the sensor is selected from a group of sensors consisting of: (i) a Hall-effect sensor; (ii) a radio frequency sensor; (iii) an optical sensor; and (iv) a micro-switch; and (v) a pressure sensor.

7. The apparatus of claim 1 further comprising a communication link for transmitting signals from the sensor to a controller.

8. The apparatus of claim 1 further comprising a controller configured to process signals from the sensor to determine rotation of the inner member.

9. The apparatus of claim 7, wherein the communication link is selected from a group consisting of: (i) a split ring connection associated with the inner member and the outer member; (ii) an acoustic sensor configured to transmit signals to an acoustic receiver spaced from the acoustic sensor; and (iii) a direct connection between the senor and the controller.

10. A method of obtaining a core from a formation, comprising:

rotating an outer member with a coring bit attached thereto to obtain the core from the formation;

receiving the core in a substantially non-rotatable member disposed in the rotating outer member; and determining rotation of the substantially non-rotatable member using a sensor during rotation of the outer rotating member, wherein the sensor includes a plurality of targets.

11. The method of claim 10 further comprising taking a corrective action when the rotation of the substantially non-rotating member is outside a selected limit.

12. The method of claim 10, wherein the corrective action is selected from a group of corrective actions consisting of: (i) altering drill bit rotation speed; (ii) altering weight-on-bit: (iii) stop receiving the core; and (iv) retrieving the core from the substantially non-rotating member; and (v) altering inclination of the outer member.

13. The method of claim 10, wherein the sensor is selected from a group consisting of: (i) a Hall-effect sensor; (ii) a radio frequency sensor; (iii) an optical sensor; and (iv) a micro-switch; and (v) a pressure sensor.

14. The method of claim 10, wherein the sensor further includes a sensing element.

15. The method of claim 14, wherein the plurality of targets are selected from a group consisting of: (i) protrusions; (ii) splines; (iii) channels; (iv) recesses; (v) radio frequency tags; (vi) a stripe patterns; (vii) color variations; and (viii) magnetic markers.

16. The method of claim 14, wherein the plurality of targets and the sensing element are located as one of: target on the inner member and the sensing element on the outer member; the target on the outer member and the sensing element on the inner member; and the target on the inner member and the sensing element on an external member axially displaced from the target.

17. The method of claim 10 further comprising:

communicating signals generated by the sensor to a controller; and processing signals received from the sensor by the controller to determine rotation of the substantially non-rotating member.

18. The method of claim 10 further comprising communicating signals from the sensor by a communication link selected from a group consisting of: (i) a split ring connection associated with the inner member and the outer member; (ii) an acoustic sensor configured to transmit signals to an acoustic receiver spaced apart from the acoustic sensor; and (iii) a direct connection between the sensor and the controller.

* * * * *